US006060111A

United States Patent [19]

Buecher et al.

[11] Patent Number: 6,060,111

[45] Date of Patent: May 9, 2000

[54] BLOCK FEEDING OF SOLID PAINT ONTO A CONTINUOUSLY MOVING METAL STRIP

[75] Inventors: Udo Wolfgang Buecher; Trevor James Horton, both of New South Wales, Australia

[73] Assignee: BHP Steel (JLA) Pty Ltd, Australia

[21] Appl. No.: 09/147,727

[22] PCT Filed: Aug. 28, 1997

[86] PCT No.: PCT/AU97/00555

§ 371 Date: Jul. 23, 1999

§ 102(e) Date: Jul. 23, 1999

[87] PCT Pub. No.: WO98/08618

PCT Pub. Date: Mar. 5, 1998

[30] Foreign Application Priority Data

Aug. 30, 1996 [AU] Australia ..... PO2045

[51] Int. Cl.[7] ..... B05D 1/40; B05C 1/06; B05C 3/18

[52] U.S. Cl. ..... 427/11; 427/367; 118/76; 118/77

[58] Field of Search ..... 427/11, 367; 118/76, 118/77, 78

[56] References Cited

U.S. PATENT DOCUMENTS 3,305,392 2/1967 Britt .
3,630,802 12/1971 Dettling .
5,407,697 4/1995 Buecher et al. ..... 427/11

FOREIGN PATENT DOCUMENTS

494672 A1 7/1992 European Pat. Off. .
578219 A1 1/1994 European Pat. Off. .

OTHER PUBLICATIONS

Patent Abstract of Japan, C–305, p. 163, JP 60–97070 (Toppan Insatsu K.K.), May 30, 1985, "Preparation of Coated Sheet".

Patent Abstract of Japan, C–490, p. 57, JP 62–250967 A2 (Sunstar Giken K.K.), Oct. 31, 1987, "Coating Apparatus".

*Primary Examiner*—Shrive Beck
*Assistant Examiner*—Jenil L Kolb
*Attorney, Agent, or Firm*—Miles & Stockbridge P.C.; John C. Kerins

[57] ABSTRACT

In a melt deposition painting station, a solid body of paint is fed onto an endless belt conveyor, incorporating a substantially planar belt flight, a head pulley, and turn round means adjacent to the contact point of the paint block and the moving steel strip and consisting of a stationary guide and an idler pulley. The turn round means is so constructed that the direction of the belt movement after the turn is at least parallel to that of the continuously moving strip and preferably at an angle away from it. The head pulley is preferably coated with a high friction material such as natural rubber. The planar belt flight is adapted to support one or more blocks of substantially solvent-free paint composition, which becomes bonded to the pliable, durable heat-resistant material of the belt. The belt causes continuous movement of the paint block towards one end of the flight to affect melting of some portion of a solid body of paint composition onto a moving strip. In its simplest form, the flight may slide upon a supporting table with the stationary guide of the turn round being the edge of the table. Alternatively, the paint block may be fed vertically downwards between two belt conveyors moving in mutually opposite direction.

26 Claims, 4 Drawing Sheets

BLOCK FEEDING OF SOLID PAINT ONTO A CONTINUOUSLY MOVING METAL STRIP

FIELD OF THE INVENTION

This invention relates to the painting of metal surfaces and in particular to the large scale continuous painting of moving substrate metal strips with ornamental and/or protective coats of paint including film forming, organic, polymeric materials.

BACKGROUND OF THE INVENTION

Typically in the production of building cladding sheets and other sheet metal products, pre-painted steel strip can be produced in a steel finishing mill. In such painting processes, paint is applied to a hot substrate strip as a liquid melted from a solid body of substantially solvent free paint composition by the contact of the body with, or the near approach of the body to the hot strip. In this context, the term "liquid" includes high viscosity liquids whose form may approach that of a soft plastic solid as well as easily flowing liquids.

The above described mode of applying liquid material to a hot substrate is referred to as "melt deposition" and the deposited liquid is commonly called and will hereinafter be referred to as the melt deposit.

Previously, the determination of the deposition rate of melt deposits for purposes other than painting has been attempted by controlling the contact pressure between the solid body and the substrate strip while maintaining constant all of the many other parameters effecting the deposition rate. Such a process is described in U.S. Pat. No. 3,630,802 to Dettling.

A problem when using Dettling type pressure controlled melt deposition processes is accurately controlling all of the parameters effecting the deposition rate thus making it difficult to obtain the low and constant deposition rates needed to produce thin paint coats of uniform thickness. This problem has led to the replacement of such processes in practice by the melt deposition technique described in Australian Patent No. 667716.

Briefly stated, Australian Patent No. 667716 discloses depositing a polymer based coating composition onto a side of a substrate metal strip moving at a constant speed by heating the strip to a temperature above the glass transition temperature of the composition and driving a solid block of the Composition towards the strip at a predetermined block speed. Apart from the block speed, the other operating parameters are only required to lie within a broad range of working values. Thus to apply a melt deposit to the strip at a precisely controlled deposition rate, it is only necessary to control the block speed without the need to closely control other operating parameters.

It is also disclosed in Australian Patent No. 667716 that the melt deposit which for thin paint coats is discontinuous is then spread over the surface of the strip by a pressure roll and emerges therefrom as a smooth, wet coating on the strip. A bead of liquid coating builds up on the strip on the upstream side of the pressure roll and the block speed may be adjusted in response to the bead size. The emergent strip then travels through a curing furnace, if necessary and is caused or allowed to cool to complete the process.

SUMMARY OF THE INVENTION

The present invention is directed towards an apparatus and method for feeding a solid block of paint composition towards a moving strip. The invention provides an apparatus for block feeding in a melt deposition painting station, including a conveyor means, said conveyor means including a substantially planar flight for conveying a solid body of paint composition, turn round means for terminating one end of said flight adjacent a face of a hot moving strip to be painted, and drive means for said conveyor means causing continuous movement of said flight towards said one end of said flight at a predetermined speed.

The conveyor means may be an endless belt conveyor including an endless belt having the substantially planar flight for conveying the solid body of paint composition or a row of rollers, a common tangent to those rollers constituting the substantially planar flight.

By controlling the drive means and consequently the speed of the flight, the apparatus in accordance with the invention is able to advance one or more solid bodies of paint composition towards the one end of the flight at a predetermined controlled rate. Once at the end of the flight the body of paint composition may then be brought into contact with the hot moving strip to be painted at a rate dependent on the speed of advancement of the flight.

In a preferred form of the invention, the turn round means terminates said flight a distance of 1 mm to 30 mm from the face of the strip and the belt on the endless belt conveyor may be heat resistent. More preferably the turn round means terminates said flight a distance of between about 3 mm to 7mm from the face of the strip.

The solid body of paint composition may be a solid block which preferably is a substantially solvent free paint composition.

In another aspect of the invention, there is provided a method of feeding a solid body of paint composition in a melt deposition painting station including the steps of loading at least one solid body of paint composition onto an endless belt conveyor means, the said conveyor means including a substantially planar flight, said conveyor means further having a turn round means for terminating one end of said flight adjacent a face of a hot moving strip to be painted and conveying said solid body of paint composition on said flight continuously towards and past said one end of said flight at a predetermined speed.

In view of the close spacing between the termination of the planar flight and the strip, it is preferable that the turn round means causes a more abrupt angular deviation of the belt from the plane of the flight than that produced by a conventional conveyor turn round means such as a head or tail pulley of large enough diameter to enable the pulley to span the full width of the belt without undue deflection. The deviation causes the belt to proceed in a direction at least parallel to the face of the strip but preferably in a direction diverging from the face of the strip.

Thus in preferred embodiments of the invention the turn round means may include a stationary guide spanning the width of the belt over which the belt slides. The stationary guide provides a small radius longitudinal corner about which the belt turns as it deviates from the planar flight at the termination thereof.

BRIEF DESCRIPTION OF THE DRAWINGS

The features object and advantages of the present invention will become more apparent from the following description of the preferred embodiment and accompanying drawings in which.

DETAILED DESCRIPTION OF THE PREFERRED EMBODIMENTS

Figure 1:
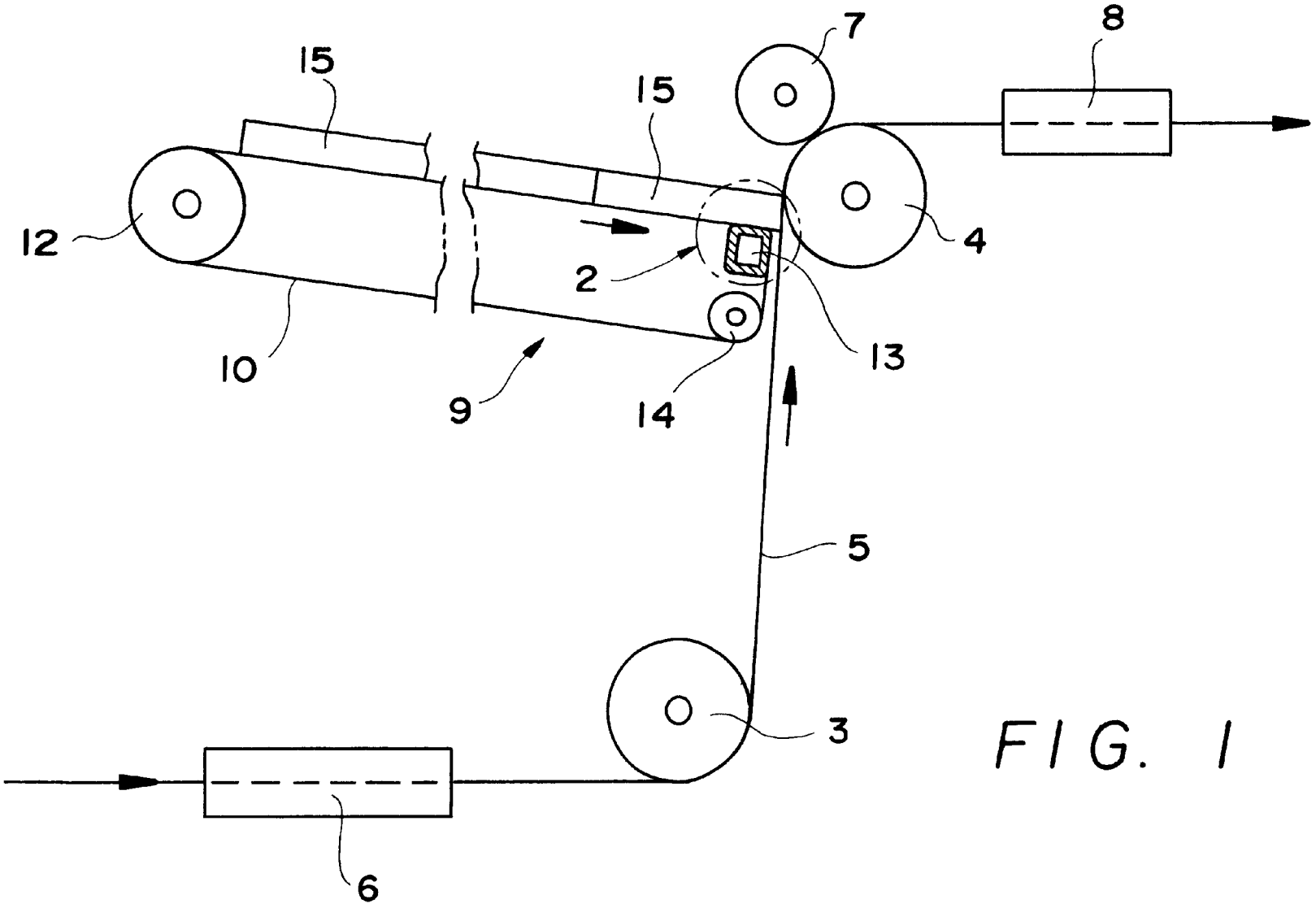
FIG. 1 is a diagrammatic, not to scale, side elevation of a continuous strip melt deposition painting apparatus including block feeding means according to the invention.
Figure 2:
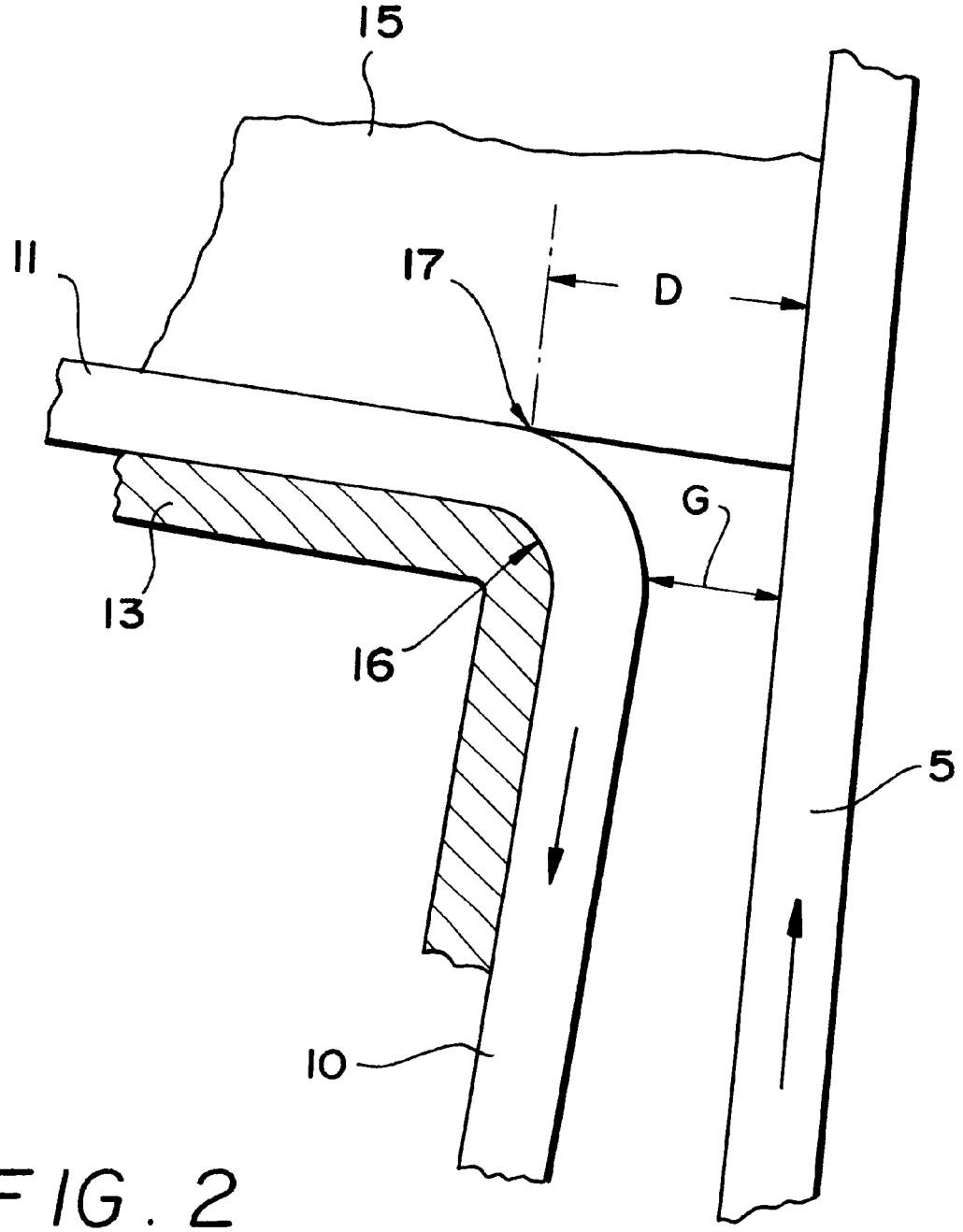
FIG. 2 is a greatly enlarged detail of a part of FIG. 1 within the enclosure marked 2 in that figure.

The illustrated painting apparatus comprises turning rolls 3 and 4 whereby a strip 5 to be painted is guided through a melt deposition station. The apparatus also includes a strip preheating furnace 6 whereby the strip 5 is brought to a temperature above the glass transition temperature of the solid paint composition to be melt deposited onto the strip. The apparatus further comprises a device for spreading and smoothing the paint, including an elastomeric roller 7, and a curing furnace 8 for use in those instances when the paint composition is thermosetting in nature.

The apparatus described in the above paragraph is in accordance with the invention proposed in the earlier mentioned Australian Patent No. 667716, the whole contents of which are herein incorporated by reference, and that earlier described apparatus could be used with any known block feeding means for melt depositing liquid paint composition on the strip at the deposition station.

However in accordance with the present invention the apparatus for block feeding includes conveyor means shown as an endless belt conveyor 9 comprising a belt 10, including a substantially planar flight 11, riding around a head pulley 12 and turn round means comprising a stationary guide 13 and an idler pulley 14. The head pulley 12 is driven by a motor and drive transmission (not shown) such that the speed of rotation of the head pulley may be accurately set at any desired value within a range of values.

The belt flight 11 is adapted to support a file of at least two blocks 15 of substantially solvent free paint composition. To that end the flight 11 may slide upon a supporting table, in which event the stationary guide of the turn round means may be no more than the end edge of that table.

In the present instance the guide 13 is a beam of standard, hollow rectangular section spanning the full width of the belt. As such, it presents a small radius, longitudinal corner 16 around which the belt 10 turns as it departs from the plane of the flight 11 at the termination 17 of the flight 11. After the turn round, the belt proceeds in a direction which is either parallel with or diverging from the face of the strip to be painted or coated.

The head pulley 12 is preferably surfaced with a high friction material such as natural rubber. It is preferably mounted on a slidable saddle or the like that is continuously urged away from the turn round means by an adjustable loading spring or the like. These arrangements provide slip free drive transmission between the head pulley 12 and the belt 10, so that the flight 11 advances towards the strip 5 at a predetermined speed set by the rotational speed of the pulley. In other embodiments the surface of the belt contacting the head pulley may be transversely ribbed or toothed and the pulley surface may be correspondingly recessed to provide a positive drive connection therebetween.

The belt 10 is made of a pliable, heat resistant, durable material. It may, for example, be a fluorinated polymer reinforced with a woven fabric of, for example, glass fibres. The belt surface in contact with the blocks 15 is preferably smooth.

Thermosetting paint compositions in block form tend to adhere to most surfaces, and the belt material referred to in the previous paragraph is certainly one such surface. This results in a high friction contact between the belt 10 and the blocks 15 so that the control of the belt speed translates into control of the block speed, as needed for control of the melt deposition rate. However, in experiments leading to the present invention it was discovered that it takes some time for the adhesion between the blocks and the belt to develop. It is thought that this arises because it takes some time for the block surface to conform to the belt surface sufficiently to establish a necessary degree of intimacy in the contact therebetween.

The speed of the belt is necessarily set to produce the requisite block speed, as dictated by the cross-sectional dimensions of the blocks 15, the width and speed of the strip 5, and the thickness required in the paint coat on the finished product. Thus the belt speed is an invariable parameter in any particular painting operation. Therefore, it is an important feature of the present invention that the conveyor 9 be long enough to enable sufficient dwell time for blocks, added to the file at the head pulley end of the conveyor, to develop sufficient adhesion with the belt before reaching the turn round end, to prevent the blocks slipping on the belt as deposition occurs.

The conveyor is preferably long enough to provide a dwell time in the order of 1 to 30 minutes. Preferably the dwell time is in the order of 3 minutes to 20 minutes and more preferably about 10 minutes.

That dwell time also enables the adhesion of the leading block in the file to the block behind it to develop to the degree that a thin slice at the tail end of the leading block does not separate from the block behind it when the plane of contact between the two blocks in question reaches the termination 17 of the flight 11 but has not reached the strip 5.

A major advantage of the melt deposition technique is the speed and facility with which colour changes may be made in the finished product. To enable the full benefit of that advantage to be obtained, it is necessary that a clean "peel" of the blocks 15 from the belt 10 is effected at the termination of the block supporting flight 11. That requirement is at odds with the need for good adhesion between the blocks and the belt as discussed above. It was found in experiments leading to the present invention that such a peel is obtained if the overhang of unmelted block beyond the termination of the supporting flight, that is to say beyond the line at which the belt first commences to depart from the plane of the flight, is short. This, in turn, requires the departure of the belt from the plane of the flight to be relatively abrupt.

In the illustrated embodiment the distance "D" between the strip 5 and the termination 17 of the flight 11 is of the order of 1 to 30 mm, preferably about 3 mm to 7 mm, so that the minimum gap "G" between the belt 10 and the moving strip 5 is within the range of from 2 mm to 5 mm.

The clean release of the blocks 15 from the belt 10 may be facilitated by chilling the belt at the end of the flight 11. This may be effected by means of separate cold gas supply nozzles directed at the underside of the end margin of the flight, or, preferably, by feeding cold gas under pressure into the interior of the hollow rectangular section guide 13 for escape through holes therein covered by the belt. This not only cools the relevant part of the belt but also beneficially reduces the frictional drag of the guide upon the belt. The degree of cooling is preferably such as to ensure that the chilled part of the belt is below the glass transition temperature of the paint composition.

The smallness of the dimensions "D" and "G" produces desirably short overhang of unsupported block. It also reduces the time that the block material is exposed to radiant heat from the strip 5 after leaving the preferably cooled belt flight 11. This, in turn, reduces the likelihood of undesirable drippage from the block.

In the event that the paint composition is of the thermoplastic type, the weight of the block may not be sufficient to bring about sufficient adhesion between the block and the belt to ensure there is no slip between the two. It may then be necessary to augment the weight of the blocks by means of pressurising means applied to the exposed faces of the blocks, for example, pressure rolls or a second, inverted, conveyor having a belt flight bearing upon those block faces. Such an arrangement may also be necessary if the blocks are being fed in a generally vertical direction towards a generally horizontally moving strip.

Such a roller, bearing upon the leading block near the termination of flight 11, may also be desirable in arrangements of the kind illustrated, in case, for example, the strip temperature falls to something less than optimum and there is a need to guard against the block then tending to be lifted away from the conveyor by the upwardly moving strip.

It will be noticed in the embodiment of FIG. 1 that the path of the strip is not truly vertical where it passes by the conveyor. It may be inclined at an angle of about 5 degrees to the vertical. This is to ensure that if any drippage of liquid paint should occur, it would fall onto the oncoming strip to be caught and drawn up by the strip to the smoothing and spreading device 7.

It will also be noticed that the travel path or direction of conveyance of the block 15 towards the strip 5 is not truly perpendicular thereto. The travel path may be inclined downwardly towards the strip 5, the angle of inclination is in the order of 10 degrees, relative to the perpendicular, preferably from about 3 degrees to 7 degrees. This ensures that the contact face between the block and the strip is angled relative to the direction of block travel in such a way that lifting of the block end in contact may only occur if the block is forced backwardly on the conveyor, and such backward movement is well resisted by the adhesion between the block and the conveyor belt. Thus, any lifting effect on the block by the strip is opposed.

Figure 3:
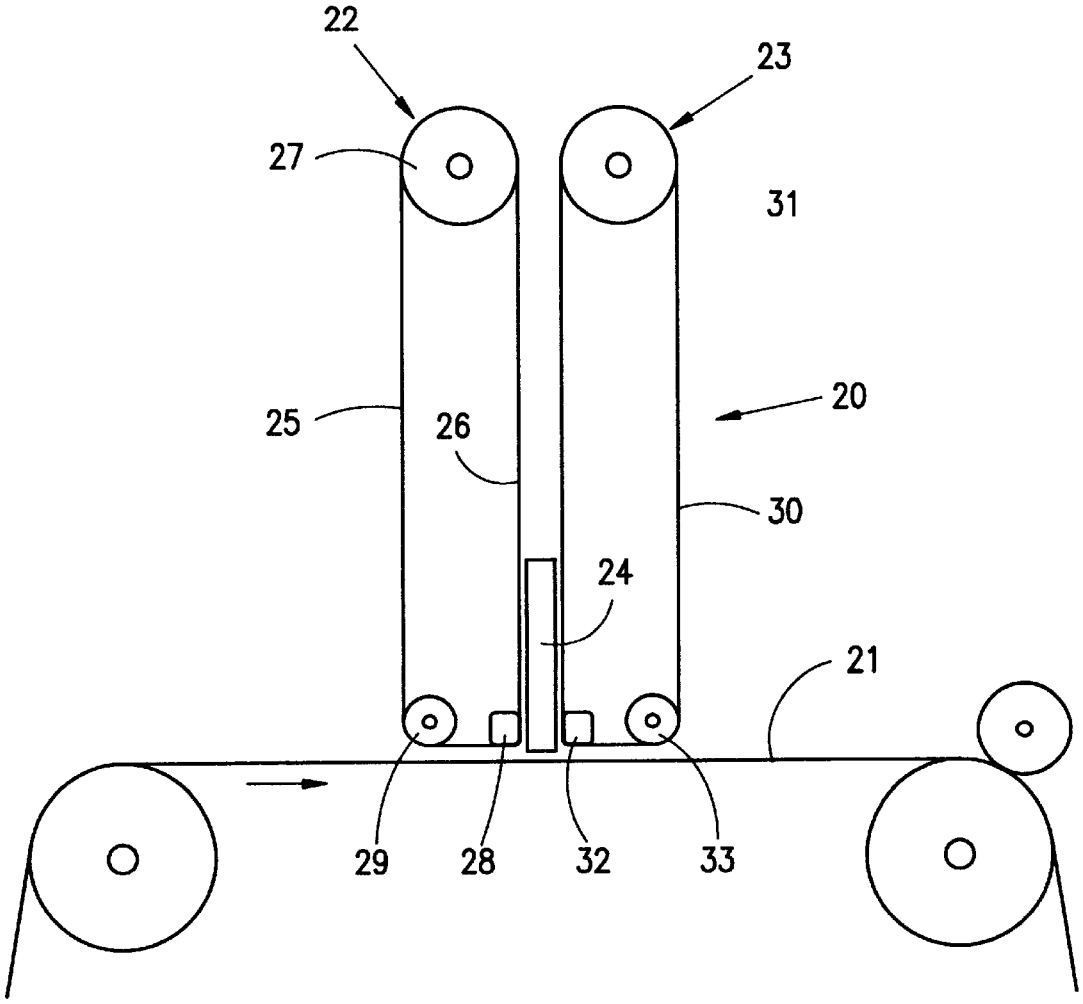
FIG. 3 is a second embodiment of the invention illustrating a vertical block feeding means and a horizontally moving strip to be painted.

In the embodiment shown in FIG. 3, a vertical feed arrangement 20 is shown feeding blocks of a paint composition onto a horizontally travelling moving strip 21. In order to control the speed of the block moving towards the moving strip, the blocks of paint composition pass between a pair of conveyor means shown as endless belt conveyors 22 and 23. The speed at which the blocks of paint composition move towards the moving strip 21 is determined by the speed of the endless belt conveyors 22 and 23 and for this purpose it is preferable that the belt conveyors 22, 23 are controlled to travel at the same speed to eliminate shear within the paint block 24. Endless belt conveyor 22 includes a belt 25 having a substantially planar flight 26 riding around head pulley 27 and a turn round means comprising a stationary guide 28 and an idler pulley 29. As in the case of the embodiment shown in FIG. 1, head pulley 27 is driven by a motor and drive transmission (not shown) and the speed of rotation of the head pulley may be accurately set at any desired value within a range of values to control the speed at which the block is progressed towards the moving strip 21. Endless belt conveyor 23 includes a belt 30 riding around a head pulley 31 and a stationary guide 32 and idler pulley 33. The direction of rotation of the endless belt conveyor 23 is opposite to that of conveyor 22, and as discussed above the speed of rotation of belt conveyor 23 is matched to be the same as that of belt conveyor 22.

While the dual conveyor system is illustrated with respect to vertical feeding a block towards a horizontally travelling moving strip, it would be appreciate by those skilled in the art that the dual conveyor means may be used in conjunction with any feeding angle to minimise errors riding to the speed of progression of the block means and providing more effective control over the speed of the block means or any angle of feeding.

In the embodiments shown in FIG. 1 and FIG. 3, the conveyor means may be either the endless belt conveyors 10, 22, 23 as shown or they may be replaced by a row of rollers, the common tangent of the rollers constituting the substantially planar flight along which the block means progresses towards the moving strip. In this alternative embodiment of conveyor means the speed of progress of the blocks are controlled by controlling the speed of rotation of the rollers. While both endless belt conveyors 22 and 23 may be replaced by a line of rollers (not shown), it is preferable that only one conveyor means is a row of rollers and in the configuration shown in FIG. 3 it is preferable that endless belt conveyor 23 is replaced by a row of pressure rollers which are controlled to progress the surface of the block in contact with those rollers at the same speed as the endless belt conveyor 22 conveys the block towards the strip 21. As stated above the dual conveyor means may be arranged at any feeding angle between horizontal and vertical.

In an alternative variation of the embodiments shown in the drawings, the invention may consist of a tandem block feeder whereby two or more block supporting flights are positioned one above the other separated by a distance greater than the thickness of the paint blocks or in side-by-side arrangement across the width of the moving strip. The two or more flights would operate in unison (ie. slide together on a common supporting table) and operate at the same time. When the conveyor means are an endless belt, the head pulleys of each flight would be able to operate independently of the other so that the speed of rotation of the belts could be the same or varied. It may also be desirable for the flights to slide on the support table independently.

Figure 4:
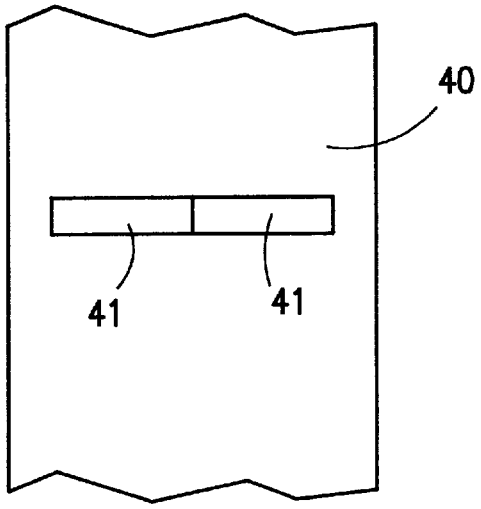
FIGS. 4 and 5 illustrate inefficient utilisation of more than one block feeding means.
Figure 5:
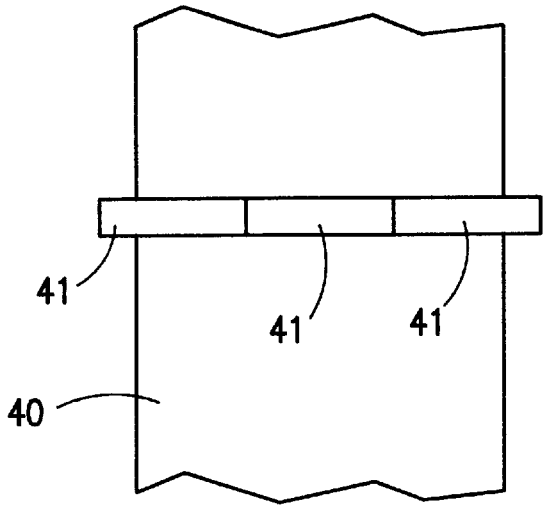
Figure 6:
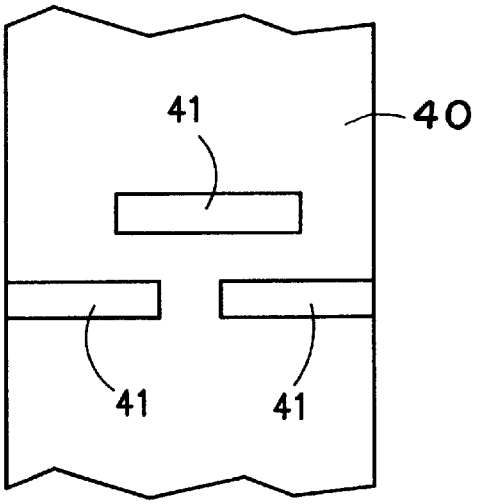
FIGS. 6 and 7 illustrate effective multiple feeding arrangements.

Another advantage of the tandem block feeding means is that thc arrangement allows painting of any width strip using a single standard size block. Without a tandem block feeding means it would only be practical to paint a strip which has a width which is close to a multiple of the block size (eg. two 300 mm wide blocks could paint a 620 mm wide strip and three blocks could paint a 920 mm block strip but it would be extremely difficult to paint a strip which is say 800 mm wide). This problem is illustrated in FIGS. 4 and 5 of the accompanying drawings in which FIG. 4 shows a moving strip 40 which has a width which is too wide to be painted by two blocks side by side but is not wide enough to efficiently use three blocks positioned side by side as in FIG. 5. With the tandem block feeding arrangement, the blocks 41 are overlapped as shown in FIG. 6, so that the coverage width of the blocks is reduced to that of the strip 40.

Figure 7:
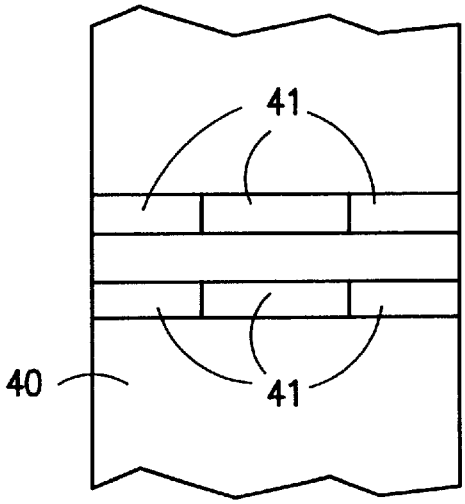

If the flights upon which the blocks 41 travel are able to slide independently of each other, then the top flight shown in FIG. 7 could be moved in and be painting in one colour while the bottom flight could be loaded with a second colour ready to paint when the first colour is no longer required. Hence the top flight can be retracted while the bottom flight is moved into the painting position to start painting and increase the speed with which the colour to be applied to the strip can be changed.

We claim:

1. An apparatus for block feeding in a melt deposition painting station, including a conveyor means, said conveyor means including a substantially planar flight for conveying a solid body of paint composition, turn round means for terminating one end of said flight adjacent a face of a hot moving strip to be painted, and drive means for said conveyor means causing continuous movement of said flight towards said one end of said flight at a predetermined speed to affect melting of some portion of a solid body of paint composition onto a moving strip.

2. The apparatus of claim 1 wherein the conveyor means includes an endless belt conveyor said endless belt conveyor including an endless belt having said substantially planar flight, the speed of movement of said flight being controlled by said drive means.

3. The apparatus of claim 1 wherein the conveyor means includes a row of rollers, said substantially planar flight being the common tangent of said rollers, the speed of rotation of said rollers being controlled by said drive means.

4. The apparatus of claim 1, wherein two conveyor means are provided, at least one conveyor means having a substantially planar flight, said solid body of paint composition being contacted by both conveyor means and moved towards the face of a hot moving strip adjacent the end of said flight.

5. The apparatus of claim 4 wherein said at least one conveyor means is an endless belt conveyor including an endless belt.

6. The apparatus of claim 1, wherein the turn round means terminates the said flight a distance in the range of about 1 to 30 mm from the face of the strip.

7. The apparatus of claim 1, wherein the turn round means terminates said flight a distance in the range of about 3 to 7 mm from the face of the strip.

8. The apparatus of claim 2 wherein the endless belt conveyor is heat resistant.

9. The apparatus of claim 1 wherein the solid body of paint composition is a solid block of a substantially solvent free paint composition.

10. The apparatus of claim 2, wherein the turn round means causes an abrupt angular deviation of the belt at said one end of the flight.

11. The apparatus of claim 10 wherein the deviation of the belt from the planar flight causes the belt to proceed in a direction which is either parallel with or diverging from the face of the strip.

12. The apparatus of claim 11 wherein the turn round means includes a stationary guide spanning the width of the belt providing a small radius longitudinal corner at the one end of said flight of said belt, said belt sliding over the stationary guide as it deviates from the planar flight.

13. The apparatus of claim 10 wherein the planar flight is inclined downwardly towards the strip.

14. The apparatus of claim 10 wherein the planar flight is inclined downwardly to the strip, the angle of inclination being in the range of about 3 degrees to 7 degrees to the perpendicular.

15. The apparatus of claim 1, including a plurality of said conveyor means arranged in tandem along the moving strip to be painted.

16. The apparatus of claim 15, including a first central conveyor means having a width which overlaps the edges of outer tandem conveyors which extend to the edges of the strip.

17. The apparatus of claim 15 including at least two tandem rows of conveyors extending across the width of the strip, one row being loaded with solid bodies of paint composition of one colour and the other row being loaded with solid bodies of paint composition of another colour, each row being operated independently of the other.

18. A method of feeding a solid body of paint composition in a melt deposition painting station including the steps of loading at least one solid body of paint composition onto a conveyor means, said conveyor means including a substantially planar flight, said conveyor means further including a turn round means for terminating one end of said flight adjacent a face of a hot moving strip to be painted and conveying said solid body of paint composition on said flight continuously towards said one end of said flight at a predetermined speed to contact said solid body with said moving strip to affect melting of some potion of the solid body of paint composition onto the moving strip.

19. The method of claim 18 wherein said conveyor means includes an endless belt conveyor, said endless belt conveyor including an endless belt, the speed of movement of said flight being controlled by a drive means for said conveyor.

20. The method of claim 18 wherein said body of paint composition is contacted by two conveyor means to convey said body towards said one end at least one conveyor means having a substantially planar flight.

21. The method of claim 18, wherein the turn round means terminates said flight a distance in the range of about 1 to 30 mm from the face of the strip.

22. The method of claim 18, wherein the turn round means terminates said flight a distance in the range of about 3 to 7 mm from the face of the strip.

23. The method of claim 18 wherein the turn round means causes an abrupt deviation of the belt from said flight to a direction which is either parallel with or diverging from the face of the strip.

24. The method of claim 18 wherein the direction of conveyance of said solid block is inclined downwardly towards the strip.

25. The method of claim 18 wherein the direction of conveyance of said solid block is inclined downwardly towards the strip, the angle of inclination being of the order of 3 degrees to 7 degrees to the perpendicular.

26. The method of claim 18 wherein the solid block of paint composition is a solid block of a substantially solvent free paint composition.

* * * * *